US010178883B2

(12) United States Patent
Bonime et al.

(10) Patent No.: US 10,178,883 B2
(45) Date of Patent: Jan. 15, 2019

(54) DROPSEAT WADERS AND SUSPENSION SYSTEM

(71) Applicant: Patagonia, Inc., Ventura, CA (US)

(72) Inventors: Bart Bonime, Ventura, CA (US); Sara Davison, Ventura, CA (US)

(73) Assignee: Patagonia, Inc., Ventura, CA (US)

( * ) Notice: Subject to any disclaimer, the term of this patent is extended or adjusted under 35 U.S.C. 154(b) by 390 days.

(21) Appl. No.: 14/289,263

(22) Filed: May 28, 2014

(65) Prior Publication Data

US 2015/0342272 A1 Dec. 3, 2015

(51) Int. Cl.

| | |
|---|---|
| ***A41D 13/012*** | (2006.01) |
| ***A41D 1/08*** | (2018.01) |
| ***A41D 13/02*** | (2006.01) |
| ***A61F 3/00*** | (2006.01) |
| ***A41F 3/00*** | (2006.01) |

(52) U.S. Cl.

CPC ..... *A41D 13/012* (2013.01); *A41D 1/08* (2013.01); *A41D 13/02* (2013.01); *A41F 3/00* (2013.01); *A41D 2400/44* (2013.01); *A41D 2600/106* (2013.01)

(58) Field of Classification Search

CPC ..... A41D 1/08; A41D 13/06; A41D 13/129; A41D 13/02; A41D 1/082; A41D 31/0016; A41D 2600/106; A41D 13/012; A41D 2400/70; A41D 2400/22; A41D 2400/44; A41F 15/00; A41F 15/002; A41F 15/02; A41F 3/00; A41F 3/02; A62B 17/001

USPC ..... 2/79, 227, 230, 247, 46, 82, 78.2, 87, 2/305, 326, 301, 457; D2/743, 901

See application file for complete search history.

(56) References Cited

U.S. PATENT DOCUMENTS

| | | | | | |
|---|---|---|---|---|---|
| 654,279 | A | * | 7/1900 | Ravich | A41D 13/02 2/79 |
| 717,392 | A | | 12/1902 | Guiterman | |
| 1,077,671 | A | * | 11/1913 | Clarke | A41F 3/00 2/326 |
| 1,168,588 | A | * | 1/1916 | Baker | A41D 13/02 2/79 |
| 1,219,326 | A | * | 3/1917 | Jones | A41D 13/02 2/79 |
| 1,572,099 | A | | 2/1926 | Jean-Baptiste | |
| 2,228,624 | A | | 1/1941 | Leopold | |

(Continued)

*Primary Examiner* — Alissa Tompkins
*Assistant Examiner* — Griffin Hall
(74) *Attorney, Agent, or Firm* — Lowe Graham Jones PLLC

(57) ABSTRACT

A trouser garment is disclosed. The trouser garment may be a fishing wader. The garment includes a quick-release dropseat to enhance the ease of personal relief, such as a WC break, without completely removing the garment. The garment may include a trouser portion, a bib portion, and a suspension system. A posterior support strap is threaded through a guide, such as a loop, to aid in the mating two ends of a quick-release dropseat buckle. The posterior support strap is coupled to left and right shoulder straps to form the suspension system. The guide and one end of the dropseat buckle are positioned on a posterior surface of the garment. The garment may include cam buckles to enable the adjustment of the left and right shoulder straps and the height of the bib portion. The garment may be worn as a full bib or as a pant.

28 Claims, 9 Drawing Sheets

(56) References Cited

U.S. PATENT DOCUMENTS 2,252,885 A * 8/1941 Fellroth ..... A41D 1/00 2/79
2,452,538 A 11/1948 Roy
2,507,382 A * 5/1950 Norvich ..... A41D 11/00 2/80
2,979,153 A * 4/1961 Hoagland ..... A41D 13/0007 182/3
3,206,767 A 9/1965 Meisberger
4,607,396 A * 8/1986 Craig ..... A41D 13/02 2/247
4,888,830 A * 12/1989 Putnam ..... A41F 3/02 2/327
4,941,209 A * 7/1990 George ..... A41D 13/02 2/77
5,172,429 A * 12/1992 Lucier ..... A41F 3/02 2/300
5,611,082 A * 3/1997 Bull ..... A41D 13/00 2/79
5,901,374 A * 5/1999 Foster ..... A41D 13/02 2/227
6,317,893 B1 * 11/2001 Walton ..... A41D 13/012 2/227
6,772,440 B1 * 8/2004 Foster ..... A41D 13/012 2/82
7,770,235 B2 * 8/2010 Lepage ..... A41D 13/012 2/275
8,898,813 B2 * 12/2014 Davis ..... A41D 13/02 2/79
2010/0306897 A1 * 12/2010 Wood ..... A41D 13/02 2/79
2012/0073028 A1 3/2012 Knopik
2013/0152263 A1 6/2013 Hare
2013/0205465 A1 * 8/2013 McClintock ..... A41D 13/012 2/82

* cited by examiner

DROPSEAT WADERS AND SUSPENSION SYSTEM

TECHNICAL FIELD OF THE INVENTION

The invention relates generally to trousers and specifically to trousers with a bib and a quick-release dropseat.

BACKGROUND OF THE INVENTION

Participants in many recreational hobbies and sports employ specialized garments, including trouser garments to provide additional protection and/or coverage than is available with traditional pants. For instance, when fishing, some people wear waterproof waders so that they may be at least partially submerged in water without getting wet. Some waders also include a bib that extends above the person's waist to enable the wearer's torso to remain dry in deeper waters.

Likewise, snow sports enthusiasts, such as snowmobilers, skiers, snowboarders, and mountaineers may wear bibbed pants to provide greater protection from exposure to snow. A bib may provide greater protection by providing a large overlapping area between the skier's waistline and the bottom of the skier's weatherproof upper layer, such as a parka. This overlapping area reduces the likelihood of snow reaching the wearer's body and also may increase the insulating capability of the combination of parka and trousers.

Pants may be at least partially secured on the wearer by employing suspenders. Suspenders often include at least two straps that are strung over the wearer's shoulders and attached to the front and back of the pants. The length of the suspenders between the front and back attachment points may be adjusted to accommodate a wide range of both torso length and torso girth. Belts are sometimes employed in conjunction with suspenders. In order to provide support for the portion above the wearer's waist, bibbed-pants often employ at least a suspender-like suspension system.

A wearer of bibbed-pants may not desire the full coverage of the bib portion at all times. For instance, when fly-fishing in a warm climate and relatively shallow water, a wearer may not want the coverage provided by the bib. Likewise, when enjoying a warm fire within the comforts of a ski lodge, a skier may wish to de-layer and avoid the coverage provided by the bib.

Furthermore, conventional suspension systems may add to the difficulty of lowering the seat of the pants. For instance, in order to relieve one's self (WC break), the wearer may have to disengage the shoulder straps and remove the pants. Disengaging the shoulder straps and/or removing the pants may prove cumbersome and time consuming. Additionally, depending on the system of overlayers the wearer is employing, disengaging the shoulder straps may require the wearer to at least partially de-layer. In some instances, the climate may a make de-layering uncomfortable or even dangerous. In severe cold weather, it may endanger a wearer to remove their parka to manipulate the shoulder straps. Depending on the complexity of the layering system, a wearer may have to disengage her gloves or over-mittens and expose extremities to the severe weather. It is for the benefit of these and other concerns that the present disclosure is offered.

SUMMARY OF THE INVENTION

The present disclosure is generally directed to a trouser garment that includes a bib. The trouser garment includes a quick-release dropseat to enhance the ease of a WC break without completely removing the garment. The wearable garment may include a trouser and a suspension system. In a preferred embodiment, the garment is a fishing wader tailored for an adult female.

In at least one embodiment, the trouser includes a first dropseat-fastener coupled to the trouser at a first location, where the first location is on a surface of a posterior portion of the trouser that is disposed approximately at a small of the wearer's back. The surface may be an interior surface of the trouser. In some embodiments, the trouser includes a guide disposed superior to the first dropseat-fastener.

The suspension system may include a posterior strap comprising a first strap end and a second strap end. In at least one of the various embodiments, the suspension system includes a second dropseat-fastener coupled to the posterior strap's first strap end. The guide is configured and arranged to receive the posterior strap. The second dropseat-fastener detachably couples to the first dropseat-fastener. In a preferred embodiment, the first and second dropseat fasteners form a quick-release style buckle. The fastener may be a female buckle end and the second fastener may be the corresponding male end of the buckle.

The suspension system may also include a right shoulder strap including a third strap end coupled to a right anterior portion of the trouser and a fourth strap end coupled to the posterior strap's second. A corresponding left shoulder strap may also be included, where the left shoulder strap includes a fifth strap end coupled to a left anterior portion of the trouser and a sixth strap end coupled to the posterior strap's second end. The right shoulder strap and left shoulder strap engage the wear's shoulders to support the trousers.

The trouser includes a seat portion and the wearer may lower the seat portion by decoupling the second dropseat-fastener from the first dropseat-fastener, such as for the occurrence of a WC break. The trouser may be secured about the wearer by threading the posterior strap through the guide and coupling the second dropseat-fastener to the first dropseat-fastener.

In some embodiments, the guide is coupled to a guide location. The guide location may be a surface, such as the interior surface, of the posterior portion of the trouser that is disposed approximately at a mid-portion of the wearer's back. For instance, after a WC break, the wearer may thread the posterior strap through the guide and couple the second dropseat-fastener to the first dropseat-fastener. The guide may aid, guide, and/or assist the wearer to locate the first dropseat buckle and couple the first and second fasteners.

In various embodiments, the guide is disposed directly below the lip of a bib portion of the trouser. The guide may include a guide strap that includes a first guide end and a second guide end. The first and the second guide ends are coupled to the trouser. In some embodiments, the guide and the interior surface of the posterior portion of the trouser form a loop configured and arranged to receive the second dropseat-fastener and at least a portion of the posterior strap.

The trouser includes a trouser portion configured and arranged to cover at least a portion of the wearer's upper legs and hip region. The trouser may also include a bib that is superior to the trouser portion. The bib portion configured and arranged to cover at least a portion of the wearer's torso.

In some embodiments, the right shoulder is coupled to the trouser at a second location. The second location may be on a right surface, such as an interior surface, of an anterior portion of the bib that is disposed above the wearer's waistline. The second location may be a right interior surface of an anterior portion of the bib that is disposed above the wearer's waistline. The left shoulder strap may be coupled to the trouser at a third location, wherein the third location is a left surface, such as the interior surface, of the anterior portion of the bib that is disposed above the wearer's waistline.

In at least one of the various embodiments, the trouser further includes at least one cam fasteners, such as cam buckles. A right cam buckle may be configured and arranged to slidably receive the right shoulder strap and is coupled to the trouser at a fourth location. The fourth location may be disposed adjacent to a lip of the bib and superior to the second location. A left cam buckle may also be included, such that the left cam buckle that is configured and arranged to slidably receive the left shoulder strap and is coupled to the trouser at a fifth location. The fifth location may be disposed adjacent to the lip of the bib and superior to the third location.

In some embodiments, when the right cam buckle is in an open state, at least a portion of the right shoulder strap may be slidably adjusted within the right cam buckle. When the right cam buckle is in a closed state, the portion of the right shoulder strap may be secured by the right cam buckle. When the left cam buckle is in an open state, at least a portion of the left shoulder strap may be slidably adjusted within the left cam buckle. When the left cam buckle is in a closed state, the portion of the left shoulder strap is secured by the left cam buckle.

In at least one of the various embodiments, the suspension system includes at least one cam buckle configured and arranged to secure a height of the bib when the at least one cam buckle is closed. The wearer may additionally be enabled to slidably adjust the height of the bib when the at least one cam buckle is open.

In some embodiments, the right shoulder strap further includes a first right shoulder strap and a second right shoulder strap. The left shoulder strap further includes a first left shoulder strap and a second left shoulder strap. The first left and first right shoulder straps may have a first elasticity value. The second left and the second right shoulder straps have a second elasticity value.

The trouser may be constructed from a plurality of laminates. At least one of the plurality of laminates may be a hydrophilic laminate configured and arranged to wick or draw moisture away from the wearer. At least one of the plurality of laminates may include a hydrophobic breathable barrier. At least one of the plurality of laminates is at least one of a puncture resistant or a tear resistant laminate. The trouser may include at least one pocket, such as a kangaroo pocket, an external pocket, an internal pocket, or a cargo pocket. The trouser may include an articulated knee portion for the wearer's comfort. In some embodiments, the trouser includes insulated booties.

In at least one embodiment, a garment includes a trouser that covers a wearer's hip region and at least a portion of the wearer's legs and a suspender system. The trouser may include a seat portion and a fastener. The fastener may be coupled to a surface of a posterior region of the trouser at a first location. In a preferred embodiment, the surface where the first fastener is coupled is an interior surface of the trouser.

The suspender system includes at least one shoulder strap coupled to an anterior portion of the garment, such as an interior surface of the anterior portion, and a posterior strap. The posterior strap is coupled to the at least one shoulder strap. In a preferred embodiment, the suspender system includes a left shoulder strap and a right shoulder strap, each coupled to the posterior strap.

The suspender system is configured and arranged such that coupling the fastener to the posterior strap enables suspending the garment about the wearer's shoulder. The suspender system is further configured and arranged such that de-coupling the fastener from the posterior strap enables lowering at least the seat portion about the wearer.

In some embodiments, the trouser further comprises a guide coupled to the surface of the posterior region of the trouser at a second location. The second location is above the first location. In a preferred embodiment, the trouser includes a bib portion covering at least a portion of the wearer's torso. The second location may be below the lip of the bib portion and the first location may be above the wearer's waistline.

The suspender system may further include at least one cam buckle configured and arranged to slidably adjust the height of the bib portion. In at least one preferred embodiment, the second location is on the interior surface of the trouser and is adjacent to the mid-portion of the wearer's back. The first location may be adjacent to the small of the wearer's back. The guide is configured and arranged to receive at least a portion of the posterior strap such that the guide aids, assists, and/or guides the wearer in coupling the fastener to the posterior strap.

In at least one embodiment, a trouser covering a wearer's hip region and at least a portion of the wearer's legs, includes a seat portion located on a posterior region of the trouser between the wearer's waistline and legs. The trouser further includes a fastener coupled to a surface, such as an interior surface, of the posterior region of the trouser at a first location. The first location is at or above the wearer's waistline. When the fastener is coupled to a suspension system worn by the wearer, the trouser is suspended on the wearer. When the fastener is uncoupled from the suspension system, the wearer is enabled to lower the seat portion without completely removing the trouser.

The trouser may further include a guide coupled to a surface, such as the interior surface, of the posterior region of the trouser at a second location. The second location is superior to the first location. The guide is configured and arranged to receive a portion of the suspension system, such as a support strap, and guide, aid, and/or assist the wearer in coupling the fastener to the suspension system. In a preferred embodiment, the trouser may includes a bib portion covering at least a portion of the wearer's torso. The second location is adjacent to a mid-portion of the wearer's back. The first location is adjacent to a small of the wearer's back. In at least one embodiment, the suspension system is a pair of suspenders.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not limit the invention, except as outlined in the claims.

Figure 1A:
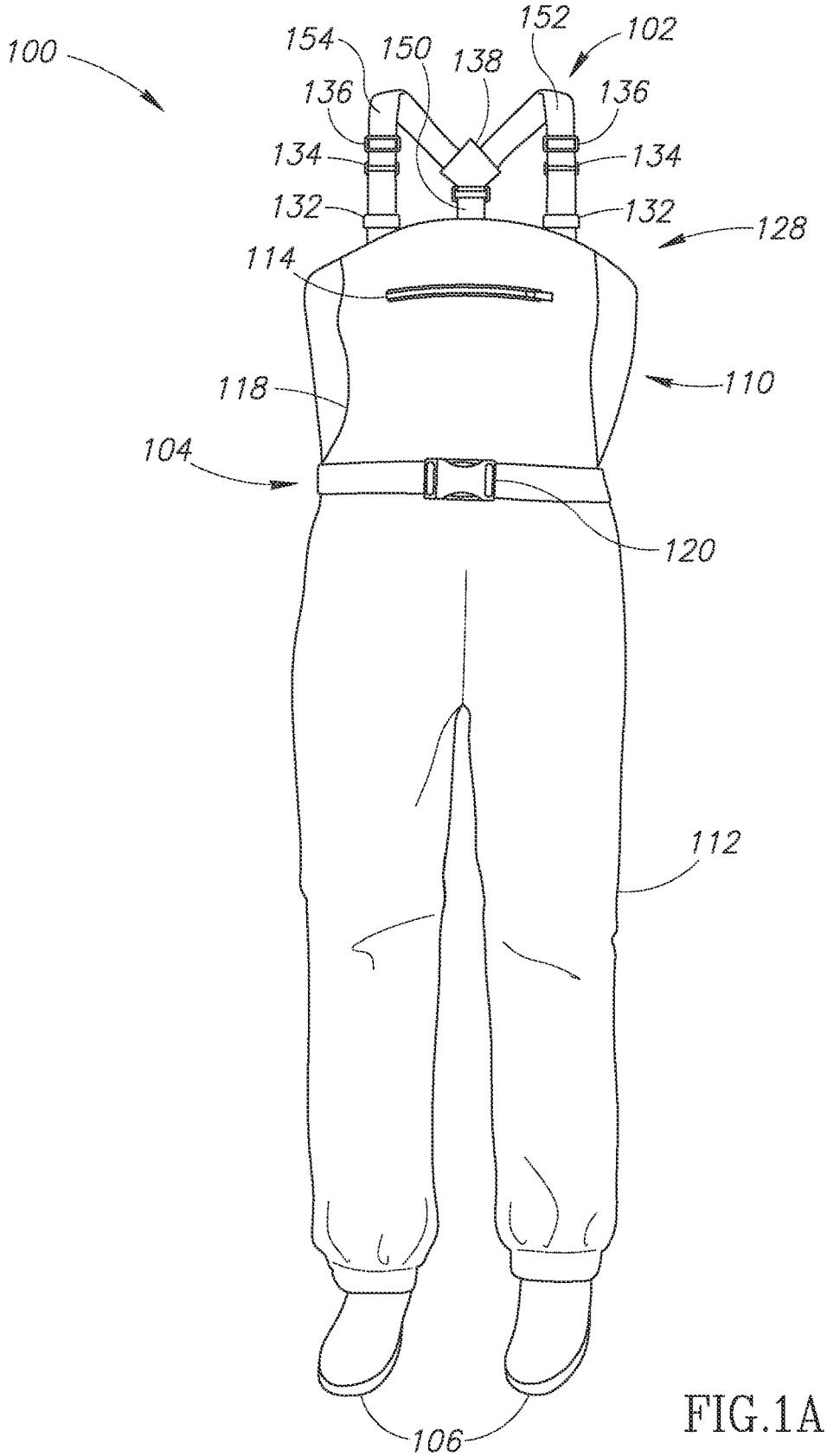
FIG. 1A shows a front view of an embodiment of a trouser garment consistent with various embodiments disclosed herein that includes a trouser portion, bib portion, and a suspension system.

FIG. 1A shows a front view of an embodiment of trouser garment 100 consistent with various embodiments disclosed herein that includes a trouser and a suspension system 102. Trouser garment 100 may be constructed from any suitable garment material, a combination of suitable garment materials, or any textile. Trouser garment 100 may be constructed using a lamination process. Trouser garment 100 may comprise one or more laminates or layers. The one or more layers may include at least one of a durable outer layer, a weatherproof layer, a waterproof layer, a water resistant layer, an insulating layer, a wicking layer, or a breathable layer. At least one of the layers, such as an inner layer, may be a hydrophilic and/or wicking layer that is enabled to draw moisture away from the body. At least one of the layers, such as an outer layer may be a tear or puncture resistant layer. The tear resistant layer may be constructed from a densely woven fabric, nylon, rubber, or other such material.

At least one of the layers, such as the outer or the inner layer, may be constructed from an insulating material. An insulating layer may be sandwiched in between the outer and inner layers. The insulating material may be natural such as wool or down. The wool may be merino wool. The insulating material may be synthetic such as fleece, synthetic down, nylon, microfiber, or any other insulating material. In a preferred embodiment, trouser garment 100 includes at least four layers.

Trouser garment 100 includes trouser portion 112 and bib portion 110. Bib portion 110 is superior to trouser portion 112. Trouser portion 112 and bib portion 110 may be constructed from similar or dissimilar materials and/or laminates. Trouser portion 112 and bib portion 110 may form a weather resistant and/or waterproof continuous garment. In at least one of the various embodiments, trouser portion 112 and bib portion 110 are detachably coupled, so that a wearer can wear trouser garment 100 with or without bib portion 110 included. Trouser portion 112 and bib portion 110 may be coupled with a zipper or any other suitable attachment means. Such a zipper may be a waterproof zipper. In at least one embodiment, trouser garment 100 includes trouser portion 112 without bib portion 110.

In a preferred embodiment, trouser garment 100 is a wader. Waders may include waders of various styles, such as fly-fishing waders. Trouser garment 100 may be a ski-, snowboard-, mountaineering-, climbing-, motorcycling-, snowmobiling-bib, or any other type of weatherproof trouser garment. However, the disclosure is not so limited, and the embodiments within may be applied to any type of trouser garment, such as an overall. In a preferred embodiment, trouser garment 100 may be tailored for an adult female. In other embodiments, trouser garment 100 may be tailored for an adult male. In at least one embodiment, trouser garment 100 is a unisex trouser garment. In at least one other embodiment, trouser garment 100 is tailored for a child.

In at least some of the various embodiments, trouser portion 112 includes feet coverings. The feet coverings may be coupled to trouser portion 112. The feet coverings may be detachable from trouser portion 112, so that a wearer may wear trouser garment 100 without feet coverings. In some embodiments, the feet coverings are weatherproof, including at least waterproof. The feet coverings may be constructed from rubber or some other material that water cannot penetrate. The feet coverings may include at least a heat-insulating barrier to minimize heat flow across the barrier. The insulating material may include merino wool or any other suitable insulating material. The wool may be arranged in a wool grid lining.

In a preferred embodiment, the feet coverings are not detachable from trouser portion 112. The feet coverings may include traction embedded on the bottom of the sole. The feet coverings may be booties 106. Booties 106 may be shaped for right and left feet. The feet coverings are preferably sized to fit within boots, such as wading boots for fishing. In at least one embodiment, trouser portion 112 does not include feet coverings.

Trouser portion 112 includes leg portions, such as a right and a left leg portion. In a preferred embodiment, booties 106 attach to lower portions of the left and right leg portions. The lower portions of the left and right leg portions may include elastic or other cinching means to stabilize the lower leg portions around booties 106. The elastic may prevent the leg portions from riding up the wearer's legs. The lower portions of the left and right leg portions may include clasps, hooks, grommets, or other such attaching means to secure gaiters, boots, traction devices such as crampons, or other such foot engaging mechanisms. In at least one embodiment, at least a segment of the lower leg portions are reinforced to enhance the durability in this region.

In some embodiments, trouser garment 100 includes one or more pockets. An included pocket may be kangaroo pocket 118. Kangaroo pocket 118 may be a lateral channel across and within bib portion 110. Kangaroo pocket 118 may include an opening on the left side of bib portion 110. Kangaroo pocket 118 may include an opening on the right side of bib portion 110. A lateral channel may be reach through both sides of bib portion 110 so that an object inserted in the left side opening may be retrieved through the right side opening and vice versa.

In at least one embodiment, there is a barrier or a baffle in the lateral channel so that the passage of an object from left to right is not possible. A wearer of the trouser may be enabled to insert at least one of their hands into kangaroo pocket 118. In some embodiments, at least a portion of an inner surface of the lateral channel is lined so to provide at least warmth or comfort to the wearer's hands. The channel may be lined with fleece, flannel, or other insulating or comforting material.

A pocket may include external bib pocket 114. In some embodiments, external bib pocket is located on an anterior portion of bib portion 110. External bib pocket 114 may be opened and closed through a zipper or any other suitable fastening means. External bib pocket 114 may be a waterproof pocket. Fastening means may be a waterproof zipper or any other suitable waterproof sealing means.

Although not shown, trouser garment 100 may include an internal bib pocket located on an anterior portion of an interior surface of bib portion 112. The internal bib pocket may be waterproof. The internal bib pocket may be sealable through a fastening means such as a plastic zipper. External bib pocket 114 and the internal bib pocket may form a single pocket accessible from within the bib portion 110 and from outside bib portion 110. In at least one embodiment, external bib pocket 114 and the internal bib pocket are separate pockets. Although not shown, some embodiments include at least one pocket on trouser portion 112, such as cargo-style pockets.

Figure 4A:
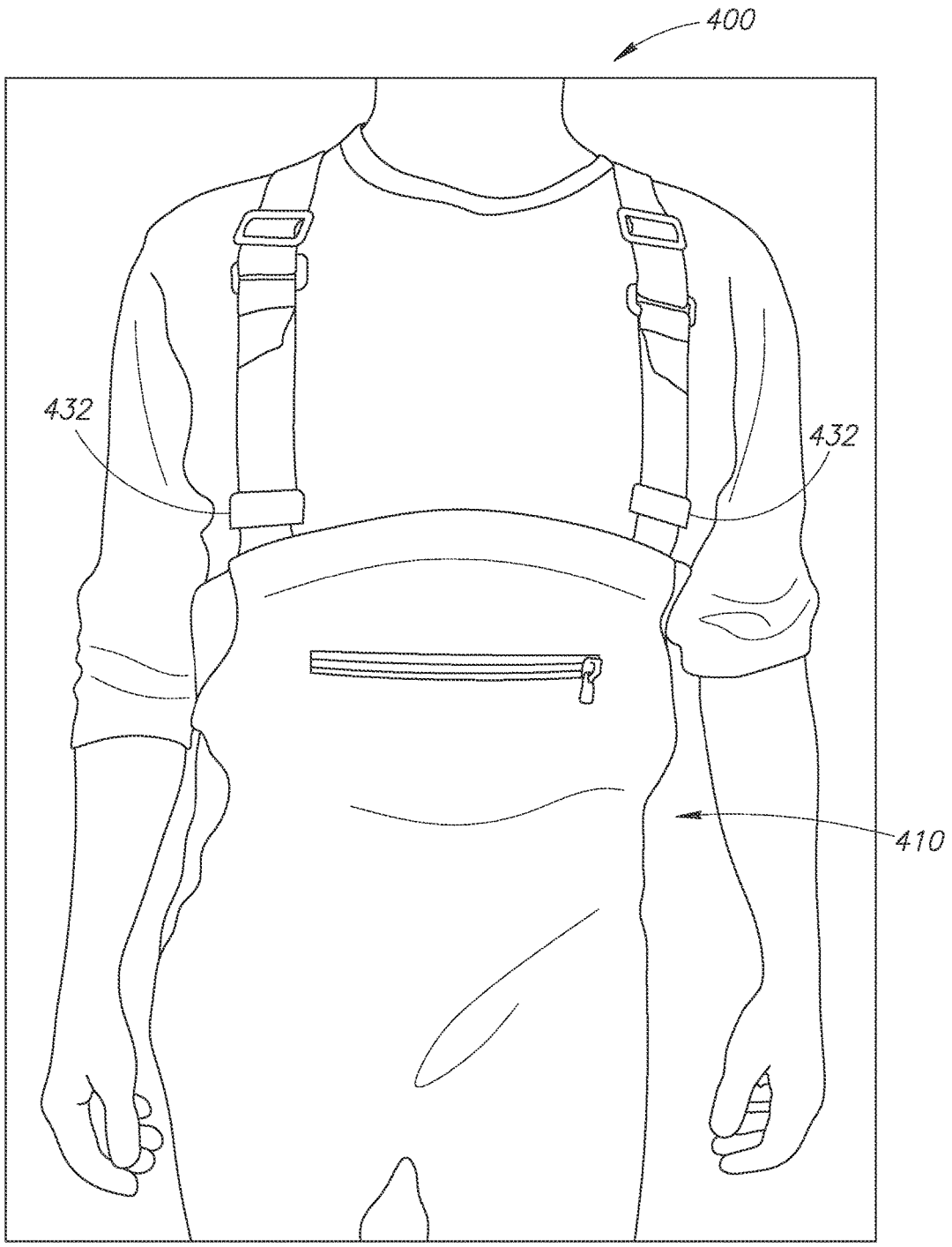
FIG. 4A shows a trouser garment consistent with various embodiments described herein on a wearer, where the bib portion is fully upright and covers a wearer's torso.
Figure 4B:
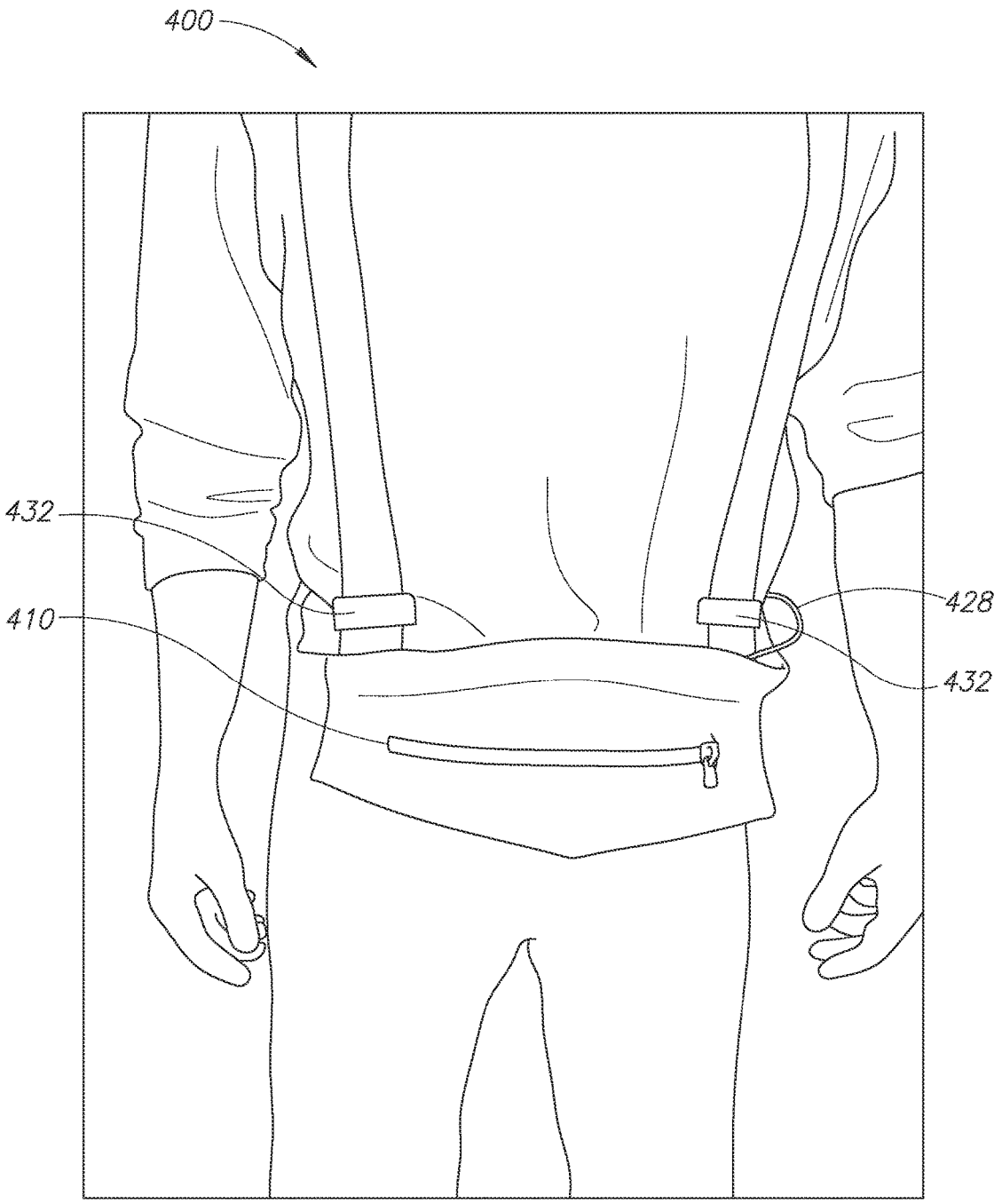
FIG. 4B shows a trouser garment consistent with various embodiments herein described on a wearer, where the bib portion has been lowered about the wearer's torso.

In some embodiments, bib portion 110 includes cinching means, such as cinching means 428 in FIG. 4B, to secure the upper portion of bib portion 110 around the wearer's upper torso. Cinching means 128 may be a cinch cord that is elastic and expands in response to the circumference of the wearer's upper torso. Cinch cord 128 may include a quick-release style clasp to release cinch cord 128 from around wearer's upper torso.

In a preferred embodiment, suspension system 102 includes belt 104 that loop around the wearer's waist. The belt may enable the suspension of at least trouser portion 112. Belt 104 may be an adjustable belt. Belt 104 may be secured around the wearer's waist through belt buckle 120. In some embodiments, belt buckle 120 is a quick-release style buckle or any other suitable buckle that may be adapted to a belt. Belt buckle 104 may include a first fastener and a second fastener. In at least one of the various embodiments, belt 104 is a completely adjustable elastic belt that increases the safety of wading while wearing trouser garment 100.

In some embodiments, suspension system 102 includes one or more support straps, such as posterior support strap 150. Each of the one or more support straps includes at least two strap-ends. One strap-end of posterior support strap 150 is coupled to an anterior portion of trouser garment 100 and the other strap-end of the posterior support strap is detachably coupled to a posterior portion of trouser garment 100.

Trouser garment 100, in some embodiments, includes at least one shoulder support strap. One strap-end of the shoulder support strap may be coupled to an anterior portion of trouser garment 100 and the other strap end may be coupled to a strap-end of posterior support strap 150 so as to couple the strap-end of the posterior support to the anterior portion of trouser garment 100.

Preferred embodiments include left shoulder support strap 152 and right shoulder support strap 154. Each of the left shoulder support strap 152 and right shoulder support strap 154 may be coupled to posterior support strap 150 at suspender spreader 138. The length of left shoulder support strap 152 and right shoulder support strap 152 may be independently adjusted with left and right buckle sliders 136. In preferred embodiments, left shoulder support strap 152, right shoulder support strap 154, and posterior support strap 150 are configured and arranged as suspenders.

In at least one embodiment, each of the left and right shoulder straps include a first and a second shoulder support straps. The first and second shoulder support straps may be coupled serially by left and right shoulder support hoops 134. Thus, the first left/right shoulder support strap may be coupled to posterior support strap at suspender spreader 138. The second left/right shoulder support strap may be coupled to the anterior portion of trouser garment 100.

Because the first and second shoulder support straps are coupled by shoulder support hoop 134, the first and second shoulder support straps may be constructed from materials or textiles with dissimilar properties. One dissimilar property may be the elasticity of the material and/or textile. Hence, the first shoulder support straps, which loop over a wearer's shoulders, may be constructed from a material with a higher elasticity than the second shoulder support straps. The higher elasticity of the first shoulder support straps may allow for a tighter fit over the shoulders and may enhance the suspension of trouser garment 100 over the wearer's shoulders.

In some embodiments, each of the second left and right shoulder support straps includes cam buckles 132. Cam buckle 132 may enable a wearer to adjust bib portion 110 so that trouser garment 100 may be work as a full wader or a pant. Additional features of suspension system 102 will be described in regards to FIGS. 2-5.

Figure 1B:
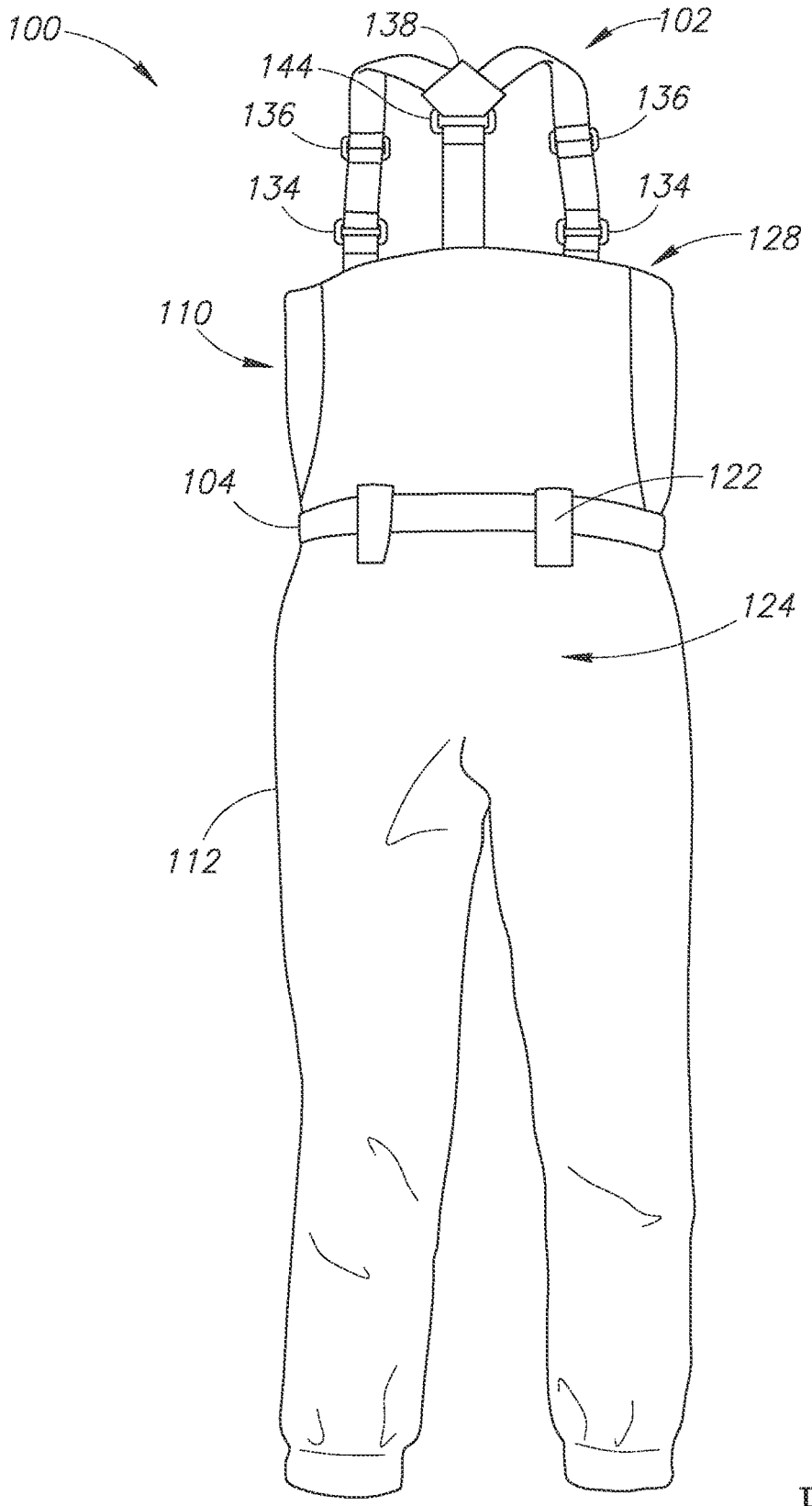
FIG. 1B shows a posterior view of trouser garment consistent with various embodiments disclosed herein that includes trouser portion, bib portion, and suspension system.

FIG. 1B shows a posterior view of trouser garment 100 consistent with various embodiments disclosed herein that includes trouser portion 112, bib portion 110, and suspension system 102. Posterior support strap 150 may be coupled to suspender spreader 138 with posterior support hoop 144. Belt 104 may pass through one or more belt loops 122 about the wearer's waistline. The posterior region of trouser portion 112 includes seat portion 124.

Figure 1C:
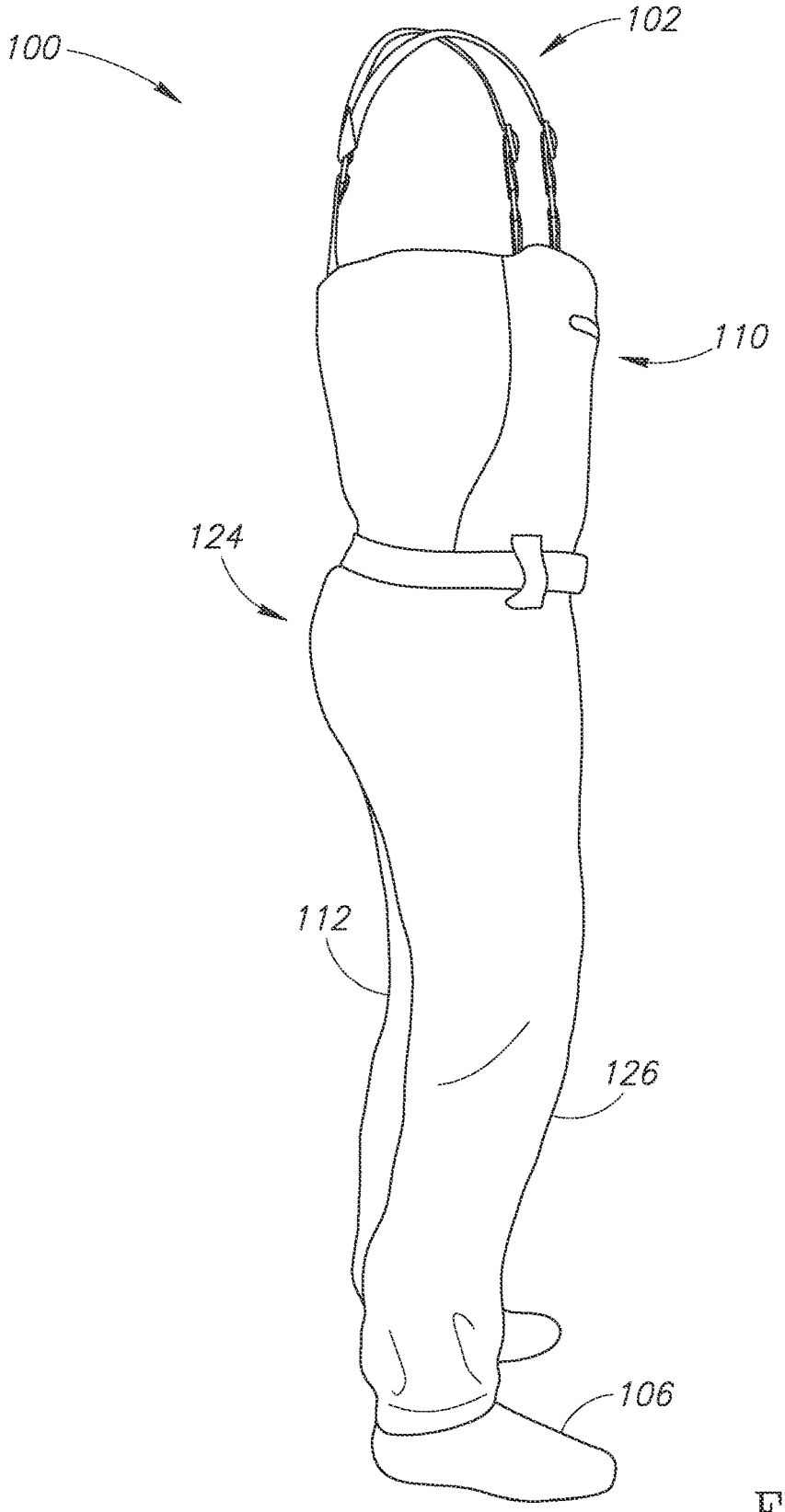
FIG. 1C shows a side view of trouser garment consistent with various embodiments disclosed herein that includes trouser portion, bib portion, and suspension system.

FIG. 1C shows a side view of trouser garment 100 consistent with various embodiments disclosed herein that includes trouser portion 112, bib portion 110, and suspension system 102. Seat portion 124 and booties 106 are additionally shown. In some embodiments, trouser portion 112 includes articulated knees 126 to enhance a wearer's comfort.

Figure 2:
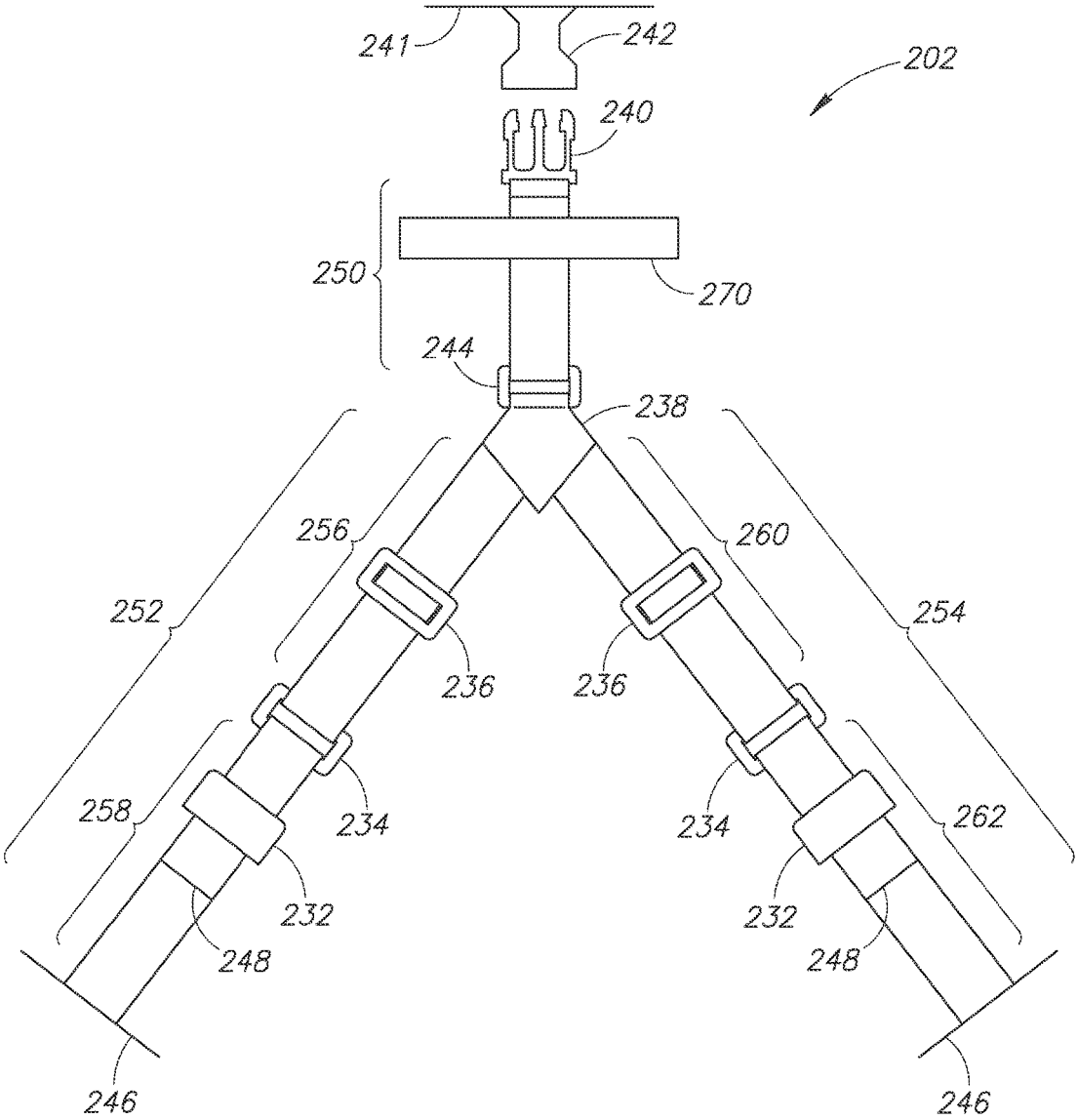
FIG. 2 shows an embodiment of suspension system that may be employed in conjunction with a trouser garment, such as the trouser garment shown in FIGS. 1A, 1B, and 1C.

FIG. 2 shows an embodiment of suspension system 202 that may be employed in conjunction with a trouser garment, such as trouser garment 100 of FIGS. 1A, 1B, and 1C. In order to show a greater level of detail, suspension system 202 is laid flat rather than coupled to a trouser garment.

Suspension system 202 includes left shoulder support strap 252, right shoulder support strap 254, and posterior support strap 250. Left shoulder support strap 252 and right shoulder support strap 254 are coupled to posterior support strap 250 through suspender spreader 238. Posterior support strap 250 is coupled to suspender spreader 238 by posterior support hoop 244.

In some embodiments, left shoulder support strap 252 includes first left shoulder support strap 256 and second left shoulder support strap 258. One end of first left shoulder support strap 256 may be coupled to suspender spreader 238. The other end of first left shoulder support strap 256 may be coupled to an end of second left shoulder support strap 258 by a left shoulder support hoop, such as shoulder support hoop 234.

The length of left shoulder support strap 252 may be varied by an adjusting means, such as buckle slider 236. In a preferred embodiment, left buckle slider 236 is located on first left shoulder support strap 256. In other embodiments, an adjusting means may be located on second left shoulder support strap 258. In at least one embodiment, and adjusting means may be positioned on posterior support strap 250. Adjusting means, such as buckle slider 236, may enable varying the overall length of suspension system 202 so that suspension system 202 may be employed by individuals with torsos with various sizes, including variations in lengths and girths.

In some embodiments, the end of left shoulder strap 252 that is not coupled to posterior shoulder strap 250 is coupled to an anterior portion a trouser garment, such as trouser garment 100 of FIGS. 1A, 1B, and 1C. As will be discussed in greater detail in regards to FIG. 3B, the end of second left shoulder strap 258 that is not coupled to first left shoulder strap by left shoulder support loop 234 may be coupled to a left interior portion of an anterior portion 246 of a trouser portion.

At least a portion of left shoulder support strap 252 may be received by left cam buckle 232. In some embodiments, second left shoulder support strap 258 passes through, or is received by, left cam buckle 232. As will be described in greater detail with regards to FIG. 3B, left cam buckle 232 may be coupled to another anterior portion of the trouser garment, such as left cam buckle coupling location 248.

In at least one of the various embodiments, right shoulder support strap 254 includes first right shoulder support strap 260 and second right shoulder support strap 262. Although embodiments of shoulder support straps include a first and a second support strap, the invention is not so constrained. It should be recognized that in some embodiments, shoulder straps may be constructed from fewer or greater numbers of straps.

In the embodiment shown in FIG. 2, the construction of right shoulder support strap 254 mirrors the construction of left shoulder support strap 252, although the invention is not so constrained. Right shoulder support strap 254 may include at least right buckle slider 236, right shoulder support hoop 234, and right cam buckle 232. Right cam buckle 232 may be coupled to trouser garment at right cam buckle coupling location 248. In some embodiments, right shoulder support strap 254 is coupled to the trouser garment at right interior portion of an anterior portion of the trouser garment 246.

Each of the straps disclosed herein may be constructed from webbing or some other suitable strap material. In a preferred embodiment, posterior support strap 250, first left shoulder support strap 256, and first right shoulder support strap 260 are constructed from elastic webbing. Also in the preferred embodiment, second left shoulder support strap 258 and second right support strap 262 are constructed from inelastic webbing.

A seat portion of the trouser garment, such as 124 of FIGS. 1B and 1C, may be dropped to enable a WC break without the complete removal of the trouser garment. In a preferred embodiment, at least one dropseat fastener may be configured and arranged to enable dropping of the seat portion. For instance, a buckle may include a first fastener mated with a second fastener. When the two fasteners are coupled or mated, the trouser garment is suspended on the wearer. Also, when the two fasteners are uncoupled, or unmated, the seat portion may be lowered. In at least one of the various embodiments, one fastener may be a male end and the other end may be a female end. A buckle may include two ends: a first buckle end and a second buckle end. In a preferred embodiment, the buckle is quick-release buckle that includes a male fastener end and a female fastener end. It should be noted that the invention is not limited to buckle style fasteners. For embodiments disclosed herein, a fastener may include buttons, snap-buttons, zippers, hook and loop material, or any other such fastener.

As will be discussed in greater detail with regards to FIG. 3A, one end of a buckle, such as dropseat buckle male end 240 may be coupled to the end of posterior support strap 250 that is not coupled to the at least one shoulder support strap. The other end of the buckle, such as dropseat buckle female end 242 may be coupled to a posterior portion 241 of the trouser garment. Thus, posterior support strap 250 may be detachably coupled to posterior portion 241 of trouser garment. Accordingly, suspension system 202 detachably suspends or supports the trouser garment on the wearer. In at least one of the various embodiments, the dropseat buckle may be a quick-release style buckle. In some embodiments, the dropseat buckle may be a fastener.

In a preferred embodiment, guide 270 is coupled to another posterior portion of the trouser garment. Guide 270 may be a loop or swatch of material that is configured and arranged to receive dropseat buckle male end 240 and a portion of posterior support strap 250. In this way, guide 270 assists or aids the wearer in mating dropseat buckle male end 240 with dropseat buckle female end 242 to engage suspension system 202. In some embodiments, dropseat buckle male end 240 is coupled to posterior portion 241 of trouser garment and dropseat buckle female end is coupled to posterior support strap 250. In a preferred embodiment, guide 270 is coupled to an interior surface of the posterior portion of the trouser garment. Likewise, dropseat buckle female end 242 is coupled to the interior surface of the posterior portion of the trouser garment and inferior to guide 270. Guide 270 may be constructed from a strap or webbing.

Figure 3A:
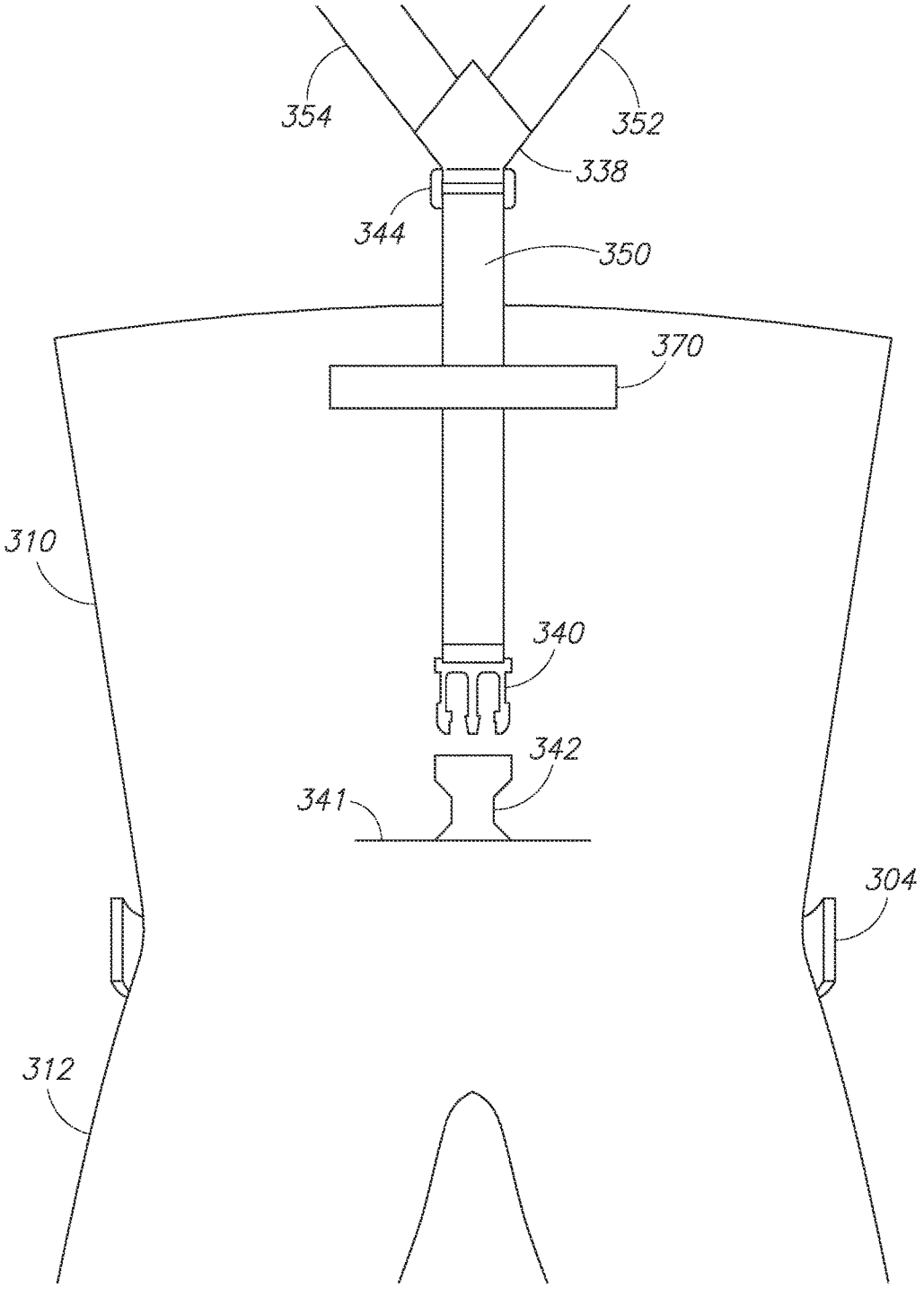
FIG. 3A shows a view of an interior surface of a posterior portion of a trouser garment consistent with embodiments disclosed herein.

FIG. 3A shows a view of an interior surface of a posterior portion of a trouser garment, such as trouser garment 100 of FIGS. 1A, 1B, and 1C, consistent with embodiments disclosed herein. Thus, the view of FIG. 3A is taken from in front of the trouser garment, such as that shown in FIG. 1A, wherein the anterior portion of the trouser garment is transparent or cut-away. Thus, in FIG. 3A, one is looking at the interior surface of the posterior of the trouser garment. The trouser garment may include bib portion 310 and trouser portion 312. FIG. 3A also demonstrates one embodiment of a suspension system that is coupled to the posterior portion of the trouser garment. In some embodiments, the suspension system includes belt 304 located about a wearer's waistline.

The suspension system may include right shoulder support strap 354, left shoulder support strap 352, and posterior support strap 350. One end of right shoulder support strap 354 and one end of left shoulder support strap 352, in various embodiments, are coupled to one end of posterior support strap 350. The shoulder straps may be coupled to suspender spreader 338. Posterior support strap 350 may be coupled to suspender spreader 338 by posterior support hoop 344.

In at least one embodiment, one end of a fastener, such as dropseat buckle male end 340 is coupled to the end of posterior support strap 350 that is not coupled to the shoulder straps. The other end of the fastener, such as dropseat buckle female end 342 is coupled to posterior portion of the trouser garment 341. In other embodiments, dropseat buckle male end 340 is coupled to the trouser garment. In such embodiments, dropseat buckle female end 342 is coupled to posterior support strap 350.

In a preferred embodiment, dropseat buckle female end 342 is coupled to an interior surface of the posterior portion 341 of the trouser garment. Location 341 where the dropseat buckle female end 342 may be coupled to just above the wearer's waistline and above belt 304. In preferred embodiments, location 341 is on an interior surface of a posterior portion of the bib portion of the trouser garment, although the invention is not so constrained. For instance, location 341 may be on an exterior surface of the posterior portion of the bib portion of the trouser garment.

Location 341 may be at or below the wearer's waistline. In at least one embodiment, location 341 may be closer to the top of the bib portion. In at least one preferred embodiment, location 341 is disposed adjacent to the small of the wearer's back. Preferably, fastener or buckle location 341 is low enough to be easily reached by the wearer.

In some embodiments, guide 370 is coupled to the posterior portion of trouser garment. Guide 370 may be a hoop or a swatch of material. Guide 370 may be configured and arranged to receive at least one end of the dropseat fastener, such as dropseat buckle male end 340, and a portion of posterior support strap 350, such as the view shown in FIG. 2. Posterior support strap 350 may be positioned between guide 370 and trouser garment such that guide 370 provides guidance for a wearer to attachably mate the two ends of the dropseat fastener or buckle. In preferred embodiments, guide 370 includes a receiving portion wherein a user may thread dropseat buckle male end 340 and posterior support strap 350 through the receiving portion of guide.

Guide 370 may be coupled to the interior surface of the posterior portion of the bib portion of the trouser garment. Guide 370 may be located above the location that the dropseat buckle end that is coupled to the interior surface of the posterior portion of the trouser garment. In at least one preferred embodiment, guide 370 is located closer to the top of the bib portion than to the location of the dropseat buckle end coupled to the trouser garment. Guide 370 may include a strip of material, where each end of the strip of material is coupled to the interior surface of the trouser so that the dropseat buckle end and posterior support strap may slide in between guide 370 and the interior surface of the trouser garment, such as that shown in FIG. 2. Guide 370 may be adjacent to the mid portion of the wearer's back and is located just beneath the lip of the bid on the interior surface of the trouser garment.

In at least one embodiment, guide 370 is located close enough to the top of the bib portion so that a user's hand may easily locate guide 370 and thread the posterior support strap 350 through the receiving portion of guide 370. By threading posterior support strap through guide 370, a wearer may more readily locate or find the other end of the dropseat buckle to mate the two ends of the dropseat buckle together. Preferably, when pulling up the trousers, the user may thread buckle male end 340 through guide 370 while that portion of the bib is low enough to easily reach. The user may then fasten the buckle together and afterwhich, raise the bib. In at least one embodiment, the material that guide 370 is constructed from is an elastic material. An elastic material may enhance the ease of feeding the dropseat buckle end and posterior support strap through guide 370.

Figure 3B:
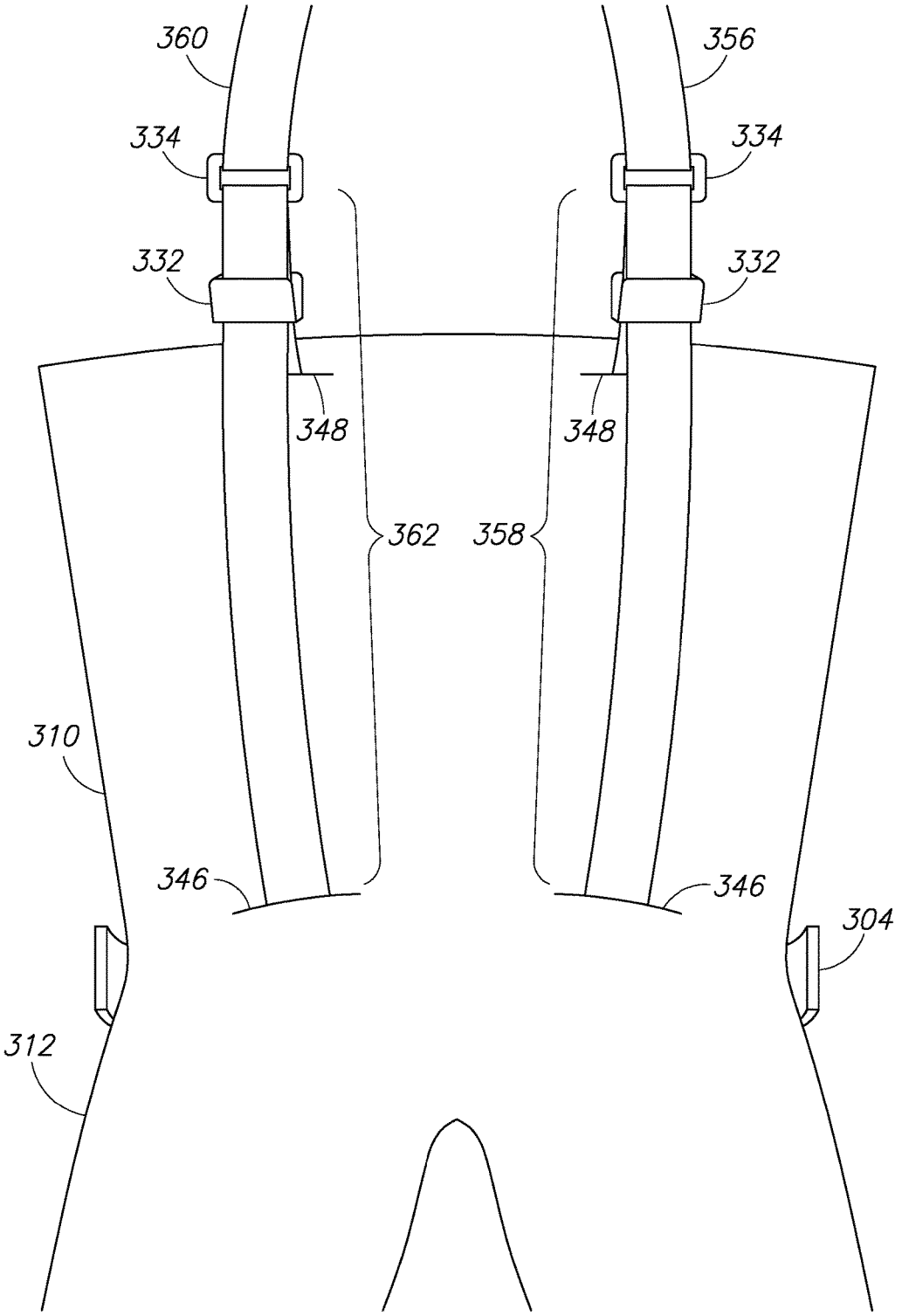
FIG. 3B shows a view of an interior surface of an anterior portion of a trouser garment consistent with embodiments disclosed herein.

FIG. 3B shows a view of an interior surface of an anterior portion of a trouser garment consistent with embodiments disclosed herein. The view shown in FIG. 3B is a complement to the view shown in FIG. 3A. Thus, the view of FIG. 3B is taken from behind the trouser garment, similar to FIG. 1B. However, in FIG. 3B, the posterior portion of the trouser garment is transparent or otherwise cut-away. Thus, one is looking at the interior surface of the anterior of the trouser garment. The trouser garment includes bib portion 310 and trouser portion 312. FIG. 3B also demonstrates one embodiment of a suspension system that is coupled to the anterior portion of the trouser garment and consistent with the embodiments described herein. In some embodiments, the suspension system includes belt 304 located about a wearer's waistline.

The suspension system may include a left shoulder support strap and a right shoulder support strap. Right shoulder support strap may include first right shoulder support strap 356 and second right shoulder support strap 358. In some embodiments, first right shoulder support strap 356 may be coupled to second right shoulder support strap by right shoulder support hoop 334.

Likewise, in some of the various embodiments, left shoulder support strap includes first left shoulder support strap 360 and second left shoulder support strap 362 coupled by left shoulder support hoop 334. An end of first right shoulder support strap 356 (not shown) and an end of first left shoulder support strap 360 (not shown) may be coupled to an end of a posterior support strap (not shown). A suspender divider, such as suspender dividers 338 of FIG. 3A may be employed to couple an end of first right shoulder support strap 356 and first left shoulder support strap 360 to the posterior support strap to form a pair of suspenders.

In at least one embodiment, the end of second right shoulder support strap 358 is coupled to the interior surface of the anterior portion of the trouser garment. The end of second right shoulder support strap 358 may be coupled to the interior surface at right location 346. In a preferred embodiment, the location 346 may be just above the wearer's waistline. In other various embodiments, location 346 may be at or below the wearer's waistline.

In a preferred embodiment, the vertical height of coupling location 346 may be similar to a vertical height of one end of a dropseat buckle or fastener coupled to the interior surface of the posterior portion of the trouser garment, such as dropseat buckle female end 342 of FIG. 3A. Second left shoulder support strap 362 may likewise be coupled to the interior surface of the anterior portion at a corresponding left location 346.

In at least one embodiment, right cam buckle 332 slidably receives a portion of the right shoulder support strap, such as second right shoulder support strap 358. Right cam buckle 332 may be coupled to the interior surface of the anterior region of the trouser garment, at right cam buckle coupling location 348. Right cam buckle 332 may be coupled to right cam buckle coupling location 348 by a hoop, segment, or loop of webbing or other such strap material.

In at least one embodiment, cam buckle coupling location 348 is above shoulder support strap coupling location 346. Cam buckle coupling location 348 may be just below a lip portion of the bib portion of the trouser garment. Likewise, left cam buckle 332 slidably receives a portion of the left shoulder support strap, such as second left shoulder support strap 362. Left cam buckle 332 may be coupled to the trouser garment at left cam buckle coupling location 348. In at least one embodiments, cam buckle 332 is a cam fastener.

In at least one embodiment, when cam buckle 332 is in closed position, cam buckle 332 secures the corresponding shoulder support strap. When cam buckle 332 is in an open position, the shoulder strap may freely slide within the cam buckle 332.

Because each of left and right cam buckle 332 is coupled to the trouser garment at the corresponding left and right cam buckle locations 348, a wearer may adjust the height of bib portion 310 by opening each of left and right cam buckles 332. When open, the user may adjust the height of bib portion 310 by sliding the second left shoulder support strap 362 and second right shoulder support strap 358 through the respective open left and right cam buckles 332. When the lip or hem portion of bib portion 310 is at the desired height, the wearer may close each cam buckle 332 to secure the position of the respective shoulder straps within cam buckles 332. Securing the position of second left shoulder support strap 362 and the position of second right shoulder support strap 358 about the corresponding left and right cam buckles 332 will secure the heights of the lip of bib portion 310. Accordingly, a wearer may wear the trouser garments as a full bib or a pant, depending on the adjustment of the height of bib portion 310.

In a preferred embodiment, first left shoulder support strap 360 and first right shoulder support strap 356 are constructed from an elastic webbing to enable the suspension of the trouser garment about the wearer's shoulders. Also, in preferred embodiments, second left shoulder support strap 362 and second right shoulder support strap 358 are constructed from a non-elastic webbing to enable the securement of the position of second shoulder support straps in closed cam buckles 332.

FIG. 4A shows trouser garment 400, consistent with various embodiments described herein, on a wearer, where bib portion 410 is fully upright and covers a wearer's torso. Cam buckles 432 are closed and secure each of the shoulder supports straps so that bib portion 410 is suspended in an upright position. In this view, the wearer is wearing the trouser garment as a full bib.

FIG. 4B shows trouser garment 400, consistent with various embodiments described herein, on a wearer, where bib portion 410 has been lowered about the wearer's torso. The left and right cam buckles 432 have been opened so that the wearer may adjust the height of the bib. In this view, the wearer is wearing the trouser garment as a pant because the wearer has adjusted the bib portion down. Note that the bib portion 410 is folded down. Cinching means 428 are also shown. In at least one embodiment, when bib portion 410 is worn down, such as in the view of FIG. 4B, cinching means 428 may have to be loosened so that bib portion 410 can be lowered about the wearer's torso.

Figure 5:
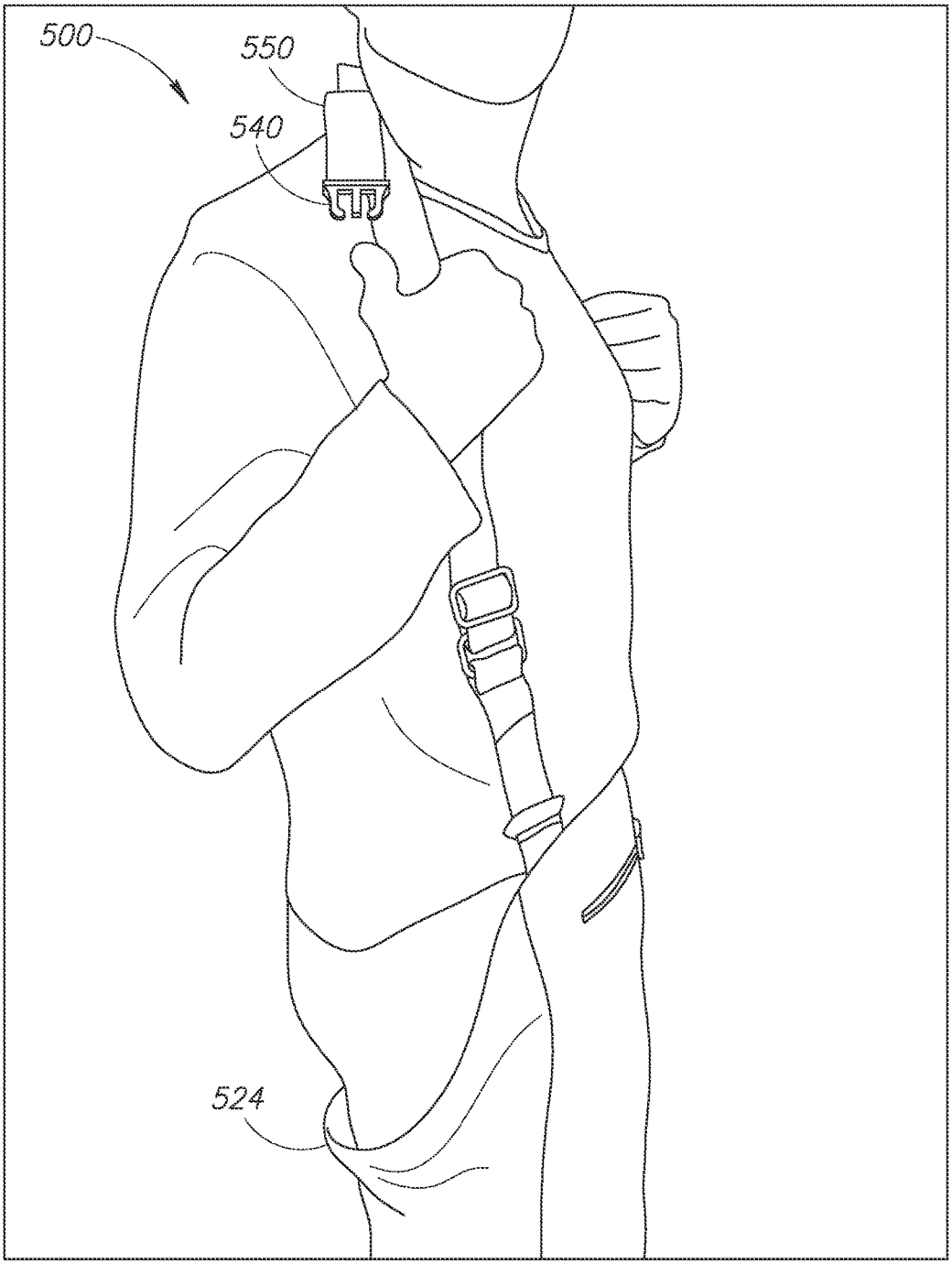
FIG. 5 shows a trouser garment, consistent with various embodiments described herein, where the posterior support strap has been decoupled from the posterior portion of the trouser to allow the dropseat to drop without completely removing the trouser garment.

FIG. 5 shows trouser garment 500, where posterior support strap 550 has been decoupled from the posterior portion of the trouser, by way of dropseat buckle. Seat portion 524 may be easily dropped to allow for relief, such as a WC break. Accordingly, in various embodiments described herein, only a single buckle or fastener may need to be decoupled to drop seat portion 524. Dropseat buckle male end 540 is shown decoupled from the dropseat buckle female end (not shown). In some embodiments, the shoulder straps may be removed from the shoulders to allow for additional clearance and to enable dropping seat portion 524 down further.

After completing the WC break, the wearer may easily bring seat portion 524 back up and into the position when the trouser garment is normally worn. The wearer may easily couple the two ends of the dropseat quick-release buckle or fastener to re-suspend trouser garment 500. In this way, the wearer need not completely remove the wader for personal relief. In at least one embodiment, a guide (not shown), such as 370 of FIG. 3A, guides, aids, and/or assists the wearer in mating the two ends of the dropseat buckle or fastener. The guide also helps position the rear portion of the bib.

All of the embodiments and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A wearable garment, comprising:

a trouser comprising;

first dropseat-fastener coupled to the trouser at a first location, wherein the first location is on a surface of a posterior portion of the trouser that is configured to be disposed approximately at a small of the wearer's back; and a guide disposed superior to the first dropseat-fastener, at least a portion of a loop being formed by the guide such that the loop is disposed on the surface of the posterior portion of the trouser completely below a top edge of the trouser and completely above the first dropseat-fastener; and a suspension system comprising:

a posterior strap comprising a first strap end and a second strap end;

a second dropseat-fastener coupled to the first strap end, wherein the loop is configured and arranged to receive at least a portion of the posterior strap between at least a portion of the guide and the surface of the posterior portion of the trouser when the second dropseat-fastener is detachably coupled to the first dropseat-fastener;

a right shoulder strap comprising a third strap end coupled to a right anterior portion of the trouser and a fourth strap end coupled to the second strap end; and a left shoulder strap comprising a fifth strap end coupled to a left anterior portion of the trouser and a sixth strap end coupled to the second strap end, such that the right shoulder strap and left shoulder strap are configured to engage the wearer's shoulders to support the trousers.

2. The garment of claim 1, wherein the trouser further comprises a seat portion and at least the seat portion may be lowered by the wearer by decoupling the second dropseat-fastener from the first dropseat-fastener.

3. The garment of claim 1, wherein the trouser is secured about the wearer by threading the posterior strap through the loop and coupling the second dropseat-fastener to the first dropseat-fastener.

4. The garment of claim 1, wherein the guide is coupled to a guide location and the guide location is on the surface of the posterior portion of the trouser that is configured to be disposed approximately at a mid-portion of the wearer's back so that the wearer is enabled to thread at least a portion of the posterior strap through the loop and couple the second dropseat-fastener to the first dropseat-fastener.

5. The garment of claim 1, wherein the guide is disposed directly below a lip of a bib portion of the trouser.

6. The garment of claim 1, wherein the guide comprises a guide strap that includes a first guide end and a second guide end, wherein the first and the second guide ends are coupled to the trouser such that the loop is configured and arranged to receive the second dropseat-fastener.

7. The garment of claim 1, wherein the trouser further comprises:

a trouser portion configured and arranged to cover at least the wearer's upper legs and hip region; and a bib that is superior to the trouser portion and configured and arranged to cover at least a portion of the wearer's torso.

8. The garment of claim 7, wherein the right shoulder strap is coupled to the trouser at a second location, wherein the second location is on a right surface of an anterior portion of the bib that is configured to be disposed above the wearer's waistline; and the left shoulder strap is coupled to the trouser at a third location, wherein the third location is on a left surface of the anterior portion of the bib that is configured to be disposed above the wearer's waistline.

9. The garment of claim 8, wherein the trouser further comprises:

a right cam buckle that is configured and arranged to slidably receive the right shoulder strap and is coupled to the trouser at a fourth location, wherein the fourth location is disposed below a lip of the bib and superior to the second location; and a left cam buckle that is configured and arranged to slidably receive the left shoulder strap and is coupled to the trouser at a fifth location, wherein the fifth location is disposed below the lip of the bib and superior to the third location.

10. The garment of claim 9, wherein:

when the right cam buckle is in an open state, at least a portion of the right shoulder strap is slidably adjustable within the right cam buckle;

when the right cam buckle is in a closed state, the portion of the right shoulder strap is secured by the right cam buckle;

when the left cam buckle is in an open state, at least a portion of the left shoulder strap is slidably adjustable within the left cam buckle;

when the left cam buckle is in a closed state, the portion of the left shoulder strap is secured by the left cam buckle.

11. The garment of claim 7 wherein the suspension system further comprises at least one cam buckle configured and arranged to secure a height of the bib when the at least one cam buckle is closed and enable the wearer to slidably adjust the height of the bib when the at least one cam buckle is open.

12. The garment of claim 1, wherein the right shoulder strap further comprises a first right shoulder strap and a second right shoulder strap and the left shoulder strap further comprises a first left shoulder strap and a second left shoulder strap, wherein the first left and the first right shoulder straps have a first elasticity value and the second left and the second right shoulder straps have a second elasticity value.

13. The garment of claim 1, wherein the trouser is constructed from a plurality of laminates.

14. The garment of claim 13, wherein at least one of the plurality of laminates is a hydrophilic laminate configured and arranged to draw moisture away from the wearer.

15. The garment of claim 13, wherein at least one of the plurality of laminates includes a hydrophobic breathable barrier.

16. The garment of claim 1, wherein the trouser further comprises at least one of an internal pocket, an external pocket, or a kangaroo pocket.

17. The garment of claim 13, wherein at least one of the plurality of laminates is at least one of a puncture resistant laminate or a tear resistant laminate.

18. The garment of claim 1, wherein the trouser further comprises an articulated knee portion.

19. The garment of claim 1, wherein the trouser further comprises insulated booties.

20. The garment of claim 1, wherein the garment is a fishing wader.

21. The garment of claim 1, wherein the guide is configured and arranged to guide the second dropseat-fastener to the first dropseat-fastener when the loop receives the posterior strap.

22. A garment comprising:

a trouser configured to cover a wearer's hip region and at least a portion of the wearer's legs, the trouser comprising:

a seat portion;

a belt;

a first end of a buckle fastener coupled to an interior surface of a posterior region of the trouser at a first location that is configured to be adjacent to a small of the wearer's back, above the belt, and completely below an upper edge of the trouser; and a suspender system comprising:

at least one shoulder strap coupled to an anterior portion of the garment;

a posterior strap coupled to the at least one shoulder strap, wherein the suspender system is configured and arranged such that coupling the first end of the buckle fastener to a second end of the buckle fastener that is coupled to the posterior strap enables suspending the garment about the wearer's shoulders and de-coupling the fastener from the posterior strap enables lowering at least the seat portion about the wearer;

wherein the trouser further comprises a guide coupled to the surface of the posterior region of the trouser at a second location, wherein the second location is above the first location and completely below the upper edge of the trouser.

23. The garment of claim 22, wherein the trouser further comprises a bib portion covering at least a portion of the wearer's torso, wherein the second location is below a lip of the bib portion and the first location is configured to be above the wearer's waistline.

24. The garment of claim 23, wherein the suspender system further comprises at least one cam buckle configured and arranged to slidably adjust a height of the bib portion.

25. The garment of claim 22, wherein the second location is configured to be adjacent to a mid-portion of the wearer's back.

26. The garment of claim 22, wherein the guide is configured and arranged to receive at least a portion of the posterior strap such that the guide aids the wearer in coupling the first dropseat-fastener to the second dropseat fastener.

27. A trouser covering a wearer's hip region and at least a portion of the wearer's legs, the trouser comprising: a seat portion located on a posterior region of the trouser and configured to be between the wearer's waistline and legs; a plurality of loops secured to an outer surface of the trouser around a waistline of the trouser; a belt positioned around the trouser and passing through the plurality of loops; a fastener coupled to an interior surface of the posterior region of the trouser at a first location that is vertically intermediate the belt and a top of a bib portion of the trouser, wherein when the fastener is coupled to a suspension system worn by the wearer, the trouser is configured to be suspended on the wearer and when the fastener is uncoupled from the suspension system the wearer is enabled to lower the seat portion without completely removing the trouser wherein the trouser further comprises a guide coupled to the interior surface of the posterior region of the trouser at a second location superior to the first location and completely below the top of the bib portion, wherein the guide is configured and arranged to receive a portion of the suspension system and guide the wearer in coupling the fastener to the suspension system.

28. The trouser of claim 27, wherein the bib portion is configured to cover at least a portion of the wearer's torso and the second location is configured to be adjacent to a mid-portion of the wearer's back and the first location is configured to be adjacent to a small of the wearer's back.

* * * * *